US005309166A

United States Patent [19]

Collier et al.

[11] Patent Number: 5,309,166

[45] Date of Patent: * May 3, 1994

[54] FERROELECTRIC-SCANNED PHASED ARRAY ANTENNA

[75] Inventors: Donald C. Collier, Newtown; Kevin J. Krug, Stamford; Brittan Kustom, Wilton, all of Conn.

[73] Assignee: United Technologies Corporation, Hartford, Conn.

[ * ] Notice: The portion of the term of this patent subsequent to Apr. 27, 2010 has been disclaimed.

[21] Appl. No.: 806,528

[22] Filed: Dec. 13, 1991

[51] Int. Cl.[5] ..... H01Q 3/30; H01P 1/18

[52] U.S. Cl. ..... 343/778; 343/754; 333/156; 333/157; 342/368

[58] Field of Search ..... 333/125, 135, 137, 156–158; 343/754, 756, 778, 785, 776, 783; 342/368, 375

[56] References Cited

U.S. PATENT DOCUMENTS

| | | | |
|---|---|---|---|
| 2,505,424 | 4/1950 | Moseley | 343/776 |
| 4,323,901 | 4/1982 | De Wames et al. | 343/754 |
| 4,636,799 | 1/1987 | Kubick | 343/754 |
| 4,706,094 | 11/1987 | Kubick | 343/754 |
| 4,809,011 | 2/1989 | Kunz | 343/754 |
| 4,987,418 | 1/1991 | Kosowsky et al. | 342/6 |
| 5,032,805 | 7/1991 | Elmer et al. | 333/156 |

*Primary Examiner*—Seungsook Ham

*Attorney, Agent, or Firm*—Richard H. Kosakowski; Patrick J. O'Shea

[57] ABSTRACT

A phased array antenna includes an array of phase shifters, each shifter being operable for shifting the phase of RF energy passing therethrough. Each shifter includes a quantity of ferroelectric material disposed throughout a region. RF energy propagating from a source passes through the material. A thin conductive electrode is disposed in the center of the material, the electrode having a bias voltage imposed thereon. Such voltage creates an electric field across the material, which for a uniaxial ferroelectric orients the optic axis of the material in a direction which is both normal to the direction of propagation of the RF energy and parallel to the polarization direction of the RF energy. The electric field changes the wave propagation constant (i.e., for a uniaxial ferroelectric, the extraordinary wave refractive index, $n_e$), producing a varying path length of the RF energy in the material, resulting in a controllable alteration of the phase of the RF energy. The varying phase shift produced by each phase shifter controls the antenna's radiating direction.

20 Claims, 3 Drawing Sheets

FERROELECTRIC-SCANNED PHASED ARRAY ANTENNA

CROSS REFERENCE TO RELATED APPLICATIONS

This application contains subject matter related to commonly assigned U.S. Pat. No. 5,206,613, Ser. No. 07/794,267.

TECHNICAL FIELD

This invention relates to phased array antennas, and more particularly to a ferroelectric-scanned phased array antenna.

BACKGROUND ART

Modern phased array antennas are limited in their application primarily by cost. Even utilizing the latest MMIC technology, the required phase shifters have a unit cost in excess of $500. With a typical array requiring 3000 individual antenna elements, each with its own phase shifter, the array price quickly becomes prohibitive.

Numerous attempts have been made to lower the cost of phased array elements. Investigations were made into the use of PIN diodes, since the diodes lent themselves to an inexpensive phase shifter design. However, no way was discovered to avoid the high insertion losses associated with the diodes, especially at the Ku frequency band and above.

Ferrite phase shifters gained popularity in recent years, as initial problems of weight, size and operational speed were overcome. But unit cost and complexity have hindered them from becoming a preferred building block.

More recently, use of ferroelectric materials has been of interest. This is because certain dielectric properties of such materials change under the influence of an electric field. In particular, an electrooptic effect can be produced by the application of a bias electric field to ferroelectric materials. By electrooptically varying the refractive indices of such material, a phase shift will occur in electromagnetic radiation passing therethrough. The overall procedure is known as electrooptic phase-shifting.

Regions of ferroelectric materials have a non-zero electric dipole moment in the absence of an applied electric field. For this reason, ferroelectric materials are regarded as spontaneously polarized. A suitably oriented polarized ferroelectric medium changes the propagation conditions of passing electromagnetic radiation. A bias electric field of sufficient magnitude in the appropriate direction may change the refractive index of the medium, thereby further altering the propagation conditions.

Upon incidence with a uniaxial ferroelectric medium having a suitably aligned optic axis, radiation divides into two components (i.e., double refraction). A first component $n_o$ exhibits polarization of the electric field perpendicular to the optic axis, and refracts in the medium according to Snell's Law (the ordinary ray). A second component $n_e$ exhibits polarization orthogonal to that of the first, with some constituent of the electric field parallel to the optic axis (the extraordinary ray). The extraordinary ray is refracted in a different manner, and may not behave according to Snell's Law.

The refractive indices of the ferroelectric material for the two wave components, $n_o$ and $n_e$ respectively, determine the different velocities of propagation of the components' phase fronts. The applied bias electric field typically changes the refractive indices, which causes phase shifts in the propagating radiation.

Examples of radar scanning devices which purported to take advantage of the foregoing principles of ferroelectric materials are disclosed and claimed in U.S. Pat. Nos. 4,636,799 and 4,706,094, both to Kubick, both assigned to the assignee of the present invention, and both of which are hereby incorporated by reference. Each patent describes and illustrates a monolithic piece of ferroelectric material disposed in front of a source of electromagnetic radio frequency ("RF") radiation. The material has a row of electrically conductive wires disposed on each side of the material and spanning the material from top to bottom. A DC voltage applied to the wires in a pattern produces a voltage gradient across the antenna aperture from one end to the other. Such a voltage gradient purportedly causes a gradient in the refractive index of the material, with a resulting shift in the radiation direction, thereby effectuating ferroelectric scanning.

Further, the ferroelectric material in Kubick U.S. Pat. No. 4,706,094 (the "electrooptic scanner patent") has an initial domain orientation parallel to the direction of propagation ("c-poled"), such c-poling being perpendicular to the surface of the ferroelectric material. With such c-poling, the radiation is affected only by the ordinary index of refraction, $n_o$. However, it has been found experimentally that the electrooptic effect manifests itself more commonly in the extraordinary wave refractive index, $n_e$. Thus, to achieve wave phase shifting, the polarization must be parallel to the optic axis, and, thus, to the bias electric field.

DISCLOSURE OF INVENTION

Objects of the present invention include overcoming the shortcomings of the aforementioned prior art by providing an electric field in an orientation with respect to a phased array antenna comprised of ferroelectric material so as to change the direction of RF energy radiating from the antenna, the electric field orientation being such that the optic axis of the ferroelectric material is orthogonal to the propagation direction of the RF energy and parallel to the polarization direction of the RF energy.

According to the present invention, a phased array antenna includes an array of phase shifters, each shifter operable to shift the phase of RF energy passing therethrough. Each shifter includes a quantity of ferroelectric material disposed in the path of the RF energy propagating from a source. A conductive electrode is disposed in the center of the material, the electrode having a bias voltage imposed thereon. Such voltage creates an electric field across the material, which for a uniaxial ferroelectric orients the optic axis of the material in a direction that is both normal to the propagation direction of the RF energy and parallel to the polarization direction of the RF energy. The electric field changes the wave propagation constant (i.e., for a uniaxial ferroelectric, the extraordinary wave refractive index, $n_e$), producing a varying path length of the RF energy in the material, resulting in a controllable alteration of the phase of the RF energy. The varying phase shift produced by each phase shifter in the arrangement controls the antenna's radiating direction.

These and other objects, features and advantages of the present invention will become more apparent in light of the detailed description of a best mode embodiment thereof, as illustrated in the accompanying drawings.

BEST MODE FOR CARRYING OUT THE INVENTION

Figure 1:
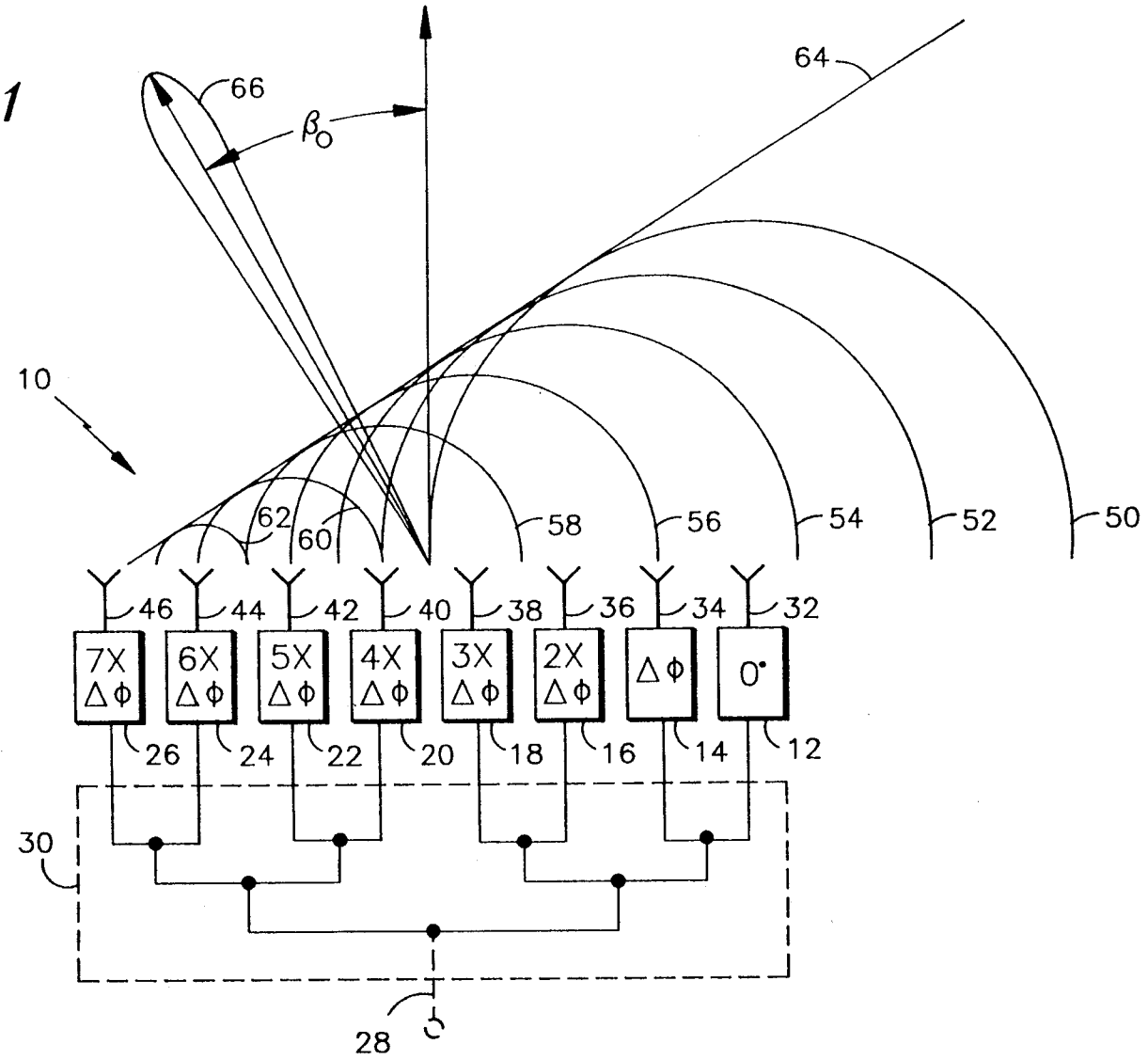
FIG. 1 is a block diagram of a phased array antenna having a plurality of RF energy phase shifting elements.

Referring to FIG. 1, there illustrated is a block diagram of a phased array antenna 10 having a plurality of RF energy phase shifting elements 12–26. Although eight shifters 12–26 are illustrated, it is to be understood that any number of a plurality of shifters may be utilized, if desired, in light of the teachings herein. RF energy is input from a source (not shown) on an input 28 to a power distribution network 30. The network 30 directs the RF energy to the shifters. Each shifter shifts the phase of the RF energy propagating therethrough relative to the phase of the RF energy entering that shifter. The phase shifted RF energy at the output of the shifters is radiated by corresponding radiating elements 32–46. Semicircles 50–62 indicate the phase fronts of the RF energy radiating from the associated radiating elements 32–46.

The phased array antenna 10 illustrated is a parallel-fed array, as determined by the type of power distribution network 30. However, the power distribution network forms no part of the present invention. Thus, it is to be understood that other types of power distribution networks, such as a series-fed network, may be employed if desired.

In the exemplary phased array antenna illustrated, the rightmost shifter 12 shifts the RF energy (relative to its phase upon entering that shifter) by zero (0) degrees. The second rightmost shifter 14 shifts the phase of the RF energy (relative to its phase upon entering that shifter) by a predetermined and controllable amount, as described in greater detail hereinafter. Thus a phase difference, $\Delta\phi$, exists between the portion of the RF energy exiting the rightmost shifter 12 and that exiting the second rightmost shifter 14, as given by:

$$\Delta\phi = (2\pi L)^{*} d^{*} \sin \beta_0 \qquad \text{(Eq. 1)}$$

where L (lambda) is the free space wavelength, d is the physical distance between the centers of the phase shifters, and $\beta_0$ is the resulting angle (with respect to the normal to the antenna) of direction of the RF energy exiting the antenna.

For example, $\Delta\phi$ may equal 20 degrees of phase shift. In a similar manner, the third rightmost shifter 16 shifts the phase of the RF energy entering that shifter by two times $\Delta\phi$, or 40 degrees relative to that exiting the rightmost shifter 12. Still further, each of the remaining shifters 18–26 shifts the phase of the RF energy propagating therethrough in an amount equal to 20 degrees ($\Delta\phi$) multiplied by an increasing integer. The result is an equiphase front indicated by the tangential line 64. A lobe 66 indicates the resulting far field radiation pattern. Thus, by controlling the phase shift produced by each shifter, the overall direction of the RF energy radiating from the antenna 10 can be controlled.

Figure 2:
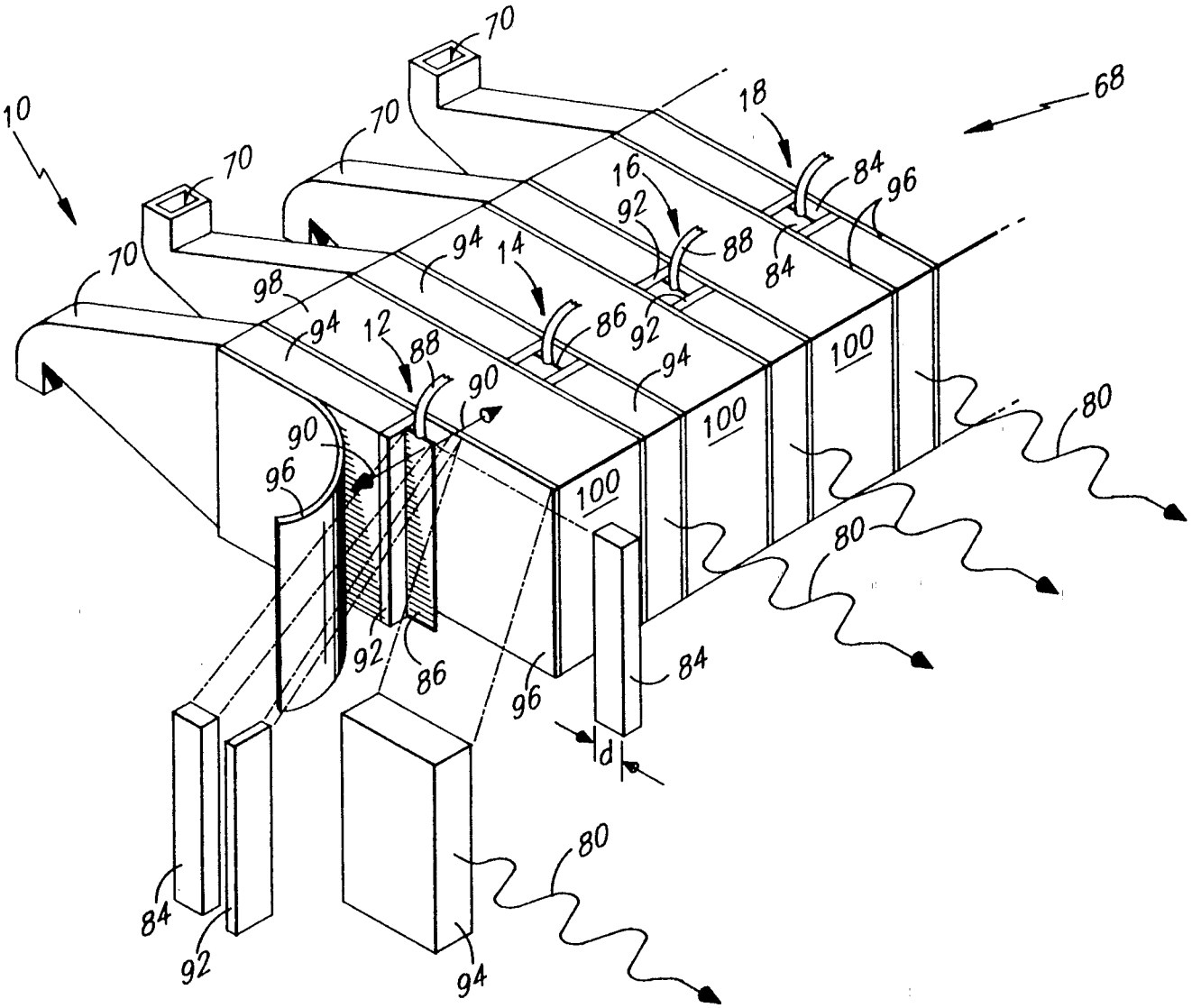
FIG. 2 is a perspective view, partially exploded, of a phased array antenna comprised of a plurality of RF energy phase shifting elements, e.g., as in FIG. 1, according to an exemplary embodiment of the present invention.

Referring to FIG. 2, the phased array antenna 10 of FIG. 1 is illustrated in a perspective view, partially exploded. The antenna is structurally similar in some respects to the prior art antenna illustrated in FIG. 1 of the aforementioned Kubick patents. The differences between the Kubick patents and the present invention lie in the novel structure described herein of ferroelectric material and electrode used to change the phase of the RF energy passing therethrough.

The antenna 10 comprises an array 68 of phase shifters 12–26. Only four shifters 12–18 are illustrated. However, any number, without limitation, of phase shifters may be utilized in the antenna of the present invention. Since all of the shifters are identical, only one shifter will be described in detail herein with the understanding that such description is equally applicable to any other shifter.

The antenna of the present invention redirects RF energy in a TEM mode that is propagating from a source, such as a flared horn 70. The frequency of the RF energy may be within the X band (8.2 GHz to 12.4 GHz) or Ku band (12.4 GHz to 18.6 GHz). Each shifter is disposed within a parallel plate or similar waveguide structure which in turn is connected to the aperture of a corresponding horn 70. The waveguide structure is described in greater detail hereinafter. The RF energy waveforms 80 illustrated propagating out of the array aperture have their electric field polarization in a direction that is both horizontal with respect to the antenna and orthogonal with respect to the propagation direction of the RF energy.

Each phase shifter includes a quantity of material 84 disposed uniformly in a region therein. The material 84 may comprise barium strontium titanate, or any other material, either ferroelectric or non-ferroelectric, having refractive index (e.g., extraordinary wave refractive index, $n_e$) properties which vary in the presence of an applied electric field. Also, the material may comprise such doping materials having metallic doping, e.g., manganese, as may be deemed necessary to minimize insertion loss and maximize the variability of permittivity of the material.

The material has substantially uniform thickness "d". The thickness is selected to establish at least a single wavelength (i.e., $2\pi$ radian) RF phase change under a selected electric field excitation level, as opposed to the RF phase in the unexcited (zero volts electric field) excitation level.

Bisecting the center of the material is an electrode 86 comprising a corresponding thin layer of conductive material, e.g., silver. The electrode 86 has a bias electrical voltage imposed thereupon. The voltage typically ranges up to several kilovolts ("KV"). The voltage originates from a power source (not shown) and is fed to the electrode by a wire 88. Such voltage creates an electric field across the material 84, which for a uniaxial ferroelectric orients the optic axis of the material in a direction that is both normal to the propagation direction of the RF energy 80 and parallel to the polarization direction of the RF energy 80. The direction of the electric field, E, (and, thus, the optic axis) is indicated by arrowheads 90. The electric field changes the wave propagation constant (i.e., for a uniaxial ferroelectric, the extraordinary wave refractive index, $n_e$), producing a varying path length of the RF energy in the material, resulting in a controllable alteration of the phase of the RF energy. The varying phase shift produced by each phase shifter in the arrangement thus controls the antenna's radiating direction.

Located adjacent to the material 84 are impedance matching layers 92. The layers 92 comprise material, e.g., magnesium calcium titanate having a dielectric constant in the range of 15-140. The refractive index is the square root of the dielectric constant, or relative permittivity. The layers are required because of the impedance mismatch between free space and the high dielectric constant (e.g., >500) of the ferroelectric material. Without these layers, the RF energy impinging upon the material would be reflected off the material faces. The resulting arrangement of material 84 and layers 92 has parallel front and back sides which are perpendicular to the propagation direction of the RF energy 80.

The magnesium calcium titanate is chosen to have a dielectric constant which equals the geometric mean of the dielectric constants of the ferroelectric material and parallel plate waveguide medium 94. The parallel plate medium 94 comprises a layer of, e.g., teflon. Such characteristic of the impedance matching layers provides for wide matching bandwidth. The layers 92 are preferably fabricated into thin sheets or layers having a selected thickness. The layers are attached to the material using adhesive or other known bonding techniques.

Assuming a dielectric constant of 625 for the ferroelectric material 84 and 2.1 for the teflon layer 94, the permittivity of each matching layer is 36 (i.e., the square root of 625*2.1). Low-loss microwave ceramics comprised of varying compositions of magnesium and calcium titanates are commercially available with dielectric constants in the range of 10 to 140, measured at the X frequency band. As these materials show no dispersion in the X band, it is expected that their dielectric properties will remain constant as the frequencies increase into the Ku frequency band. To achieve optimal radiation coupling, the impedance matching layers must be a quarter wavelength thick at the operating frequency. Such characteristic of the layers may reduce reflections off the ferroelectric material by nearly 100%. For a permittivity of 25, the matching layer the thickness is 0.159 cm (about 59 mils) for operation at 10 GHz. Through use of impedance matching layers, the thickness, d, of the ferroelectric material can be freely varied, limited only by structural considerations and insertion loss.

Disposed on each side of the impedance matching layers are thin sheets or plates 96 of conductive metallic material. The plates 96 form a pair of parallel plate waveguides. Each pair of guides has the teflon layer 94 therebetween. The teflon layer and plates direct the RF energy from the horn 70 into and through the material 84. The plates 96 are further disposed across surfaces of the impedance matching layers 92 and material. Each plate is held at electrical ground, to facilitate the direction of the electric field produced by the voltage on the electrode.

The phase shifters 12-18 are separated from one another by a spacer 98 of low dielectric material, such as teflon or nylon. A facing surface 100 of the spacer 98 is metallized to provide electrical continuity with the ends of the parallel plates 96, thereby preventing any degradation of the RF energy pattern due to diffraction.

The electrode wires 88 individually connect to a voltage source (not shown) through a known electronic circuitry switch/addressing ("S/A") function (not shown). The S/A function controls the application of the voltage to the individual wires. The S/A function may comprise, e.g., a number of parallel switches each independently controllable and in series with variable resistances (not shown), thereby applying variable voltage levels to the wires.

In accordance with the present invention, the voltage on each wire creates an electric field across the ferroelectric material 84 orthogonally to the propagation direction of the RF energy 80. The magnitude of the voltage on each wire is chosen so that a pattern of ascending voltage differences, all in the same direction, results across each region of ferroelectric material. Further, the voltage magnitude must be sufficient to vary the extraordinary refractive index, $n_e$, of the ferroelectric material.

The RF energy impinges on and penetrates the ferroelectric material located in the parallel plate waveguides. According to the present invention, the wavelength of the RF energy is modified spatially by electrooptically varying the refractive index of the ferroelectric material. This is accomplished by applying the electric field in an appropriate direction. Accordingly, the RF energy component polarized orthogonally to the material travels therethrough at a speed determined by an extraordinary refractive index, $n_e(O)$, if the material is not subject to an electric field. However, if the material is subject to a selected level of electric field, E, then the refractive index of the ferroelectric material is at a selected value, $n_e(E)$, which can be selectively set by the magnitude of the bias electric field.

The two aforementioned Kubick patents claimed operation in the millimeter wavelength band. This corresponds to a frequency range of 40-100 GHz. However, it was discovered experimentally that the present invention is not limited as such; it has been observed that the electrooptic activity involved in the present invention occurred at frequencies in the X and Ku bands ($\approx$8-18 GHz). Further, the present invention is not limited to even such a frequency range; the invention may be used at any frequency where the aforedescribed electrooptic effect is observed. This may be anywhere in the microwave or millimeter range, or approximately in a frequency range of 1 GHz to 100 GHz.

The invention has been described for use in a phased array antenna having a specific structure. However, the antenna illustrated in FIG. 2 is purely exemplary; it should be apparent to one of ordinary skill in the art that other phased array antennas may be constructed using the novel ferroelectric and electrode arrangement of the present invention, in light of the teachings herein.

Figure 3:
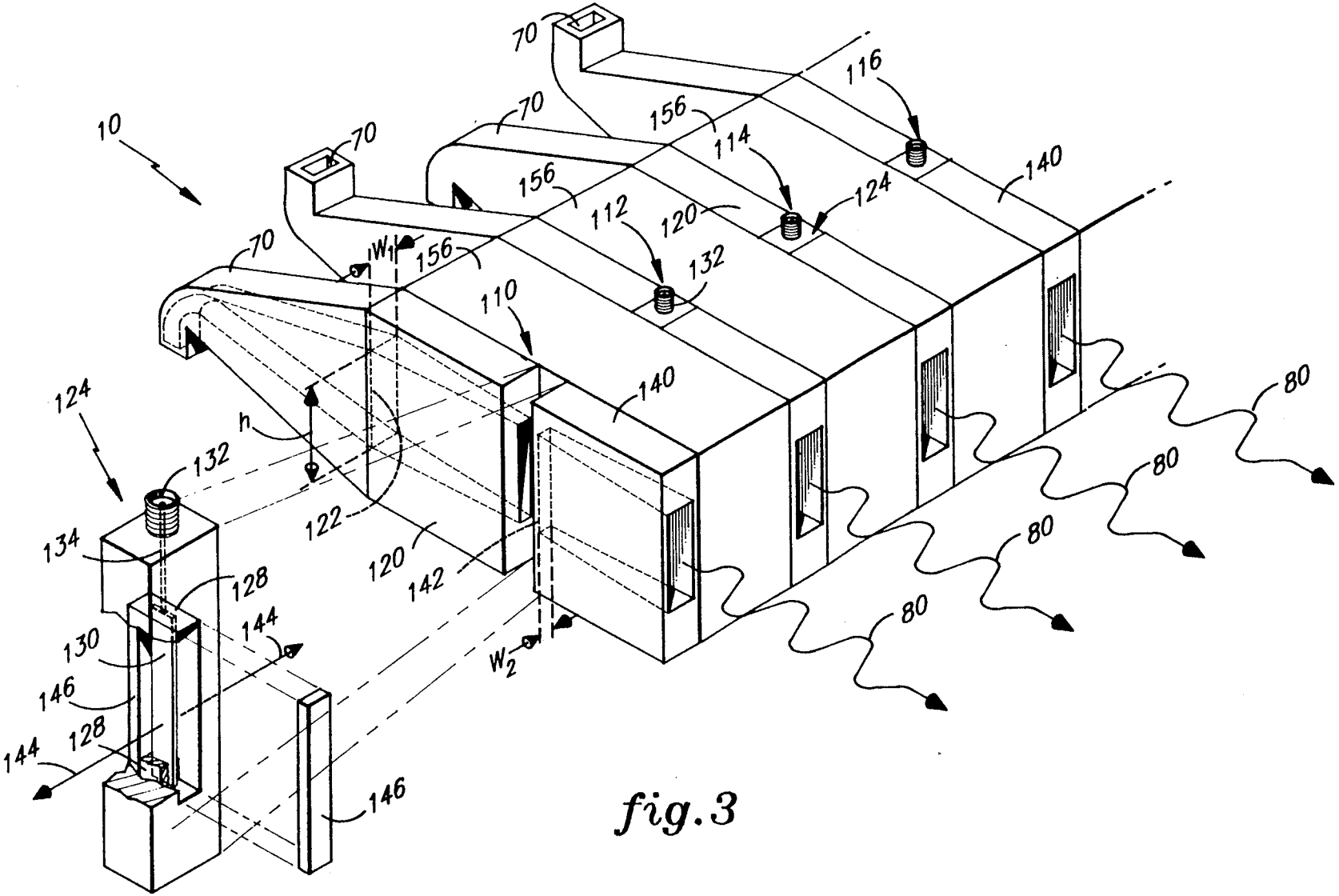
FIG. 3 is a perspective view, partially exploded, of a phased array antenna comprised of a plurality of RF energy phase shifting elements, e.g., as in FIG. 1, according to another exemplary embodiment of the present invention.

For example, an alternative embodiment of a phased array antenna 10 according to the present invention is illustrated in FIG. 3. This antenna is similar in many respects to that of FIG. 2 in that it comprises an array of identical phase shifting elements 110-116. Only one shifter will be described herein, with the understanding that such description is equally applicable to any other shifter.

RF energy from a source such as the flared horn 70 propagates through a waveguide 120. In this embodiment, the waveguide 120 comprises a conventional, metallic guide with an opening 122 formed therein (indicated by the phantom lines). The waveguide is described in greater detail hereinafter. The RF energy propagates in the opening 122 in the guide 120 until it encounters a phase shifting flange 124, shown in greater detail in an exploded view.

The flange 124 comprises brass or other suitable metallic material. In the flange is formed a narrow rectangular slot. A quantity of material 128 is disposed completely in the slot. The material 128 may comprise barium strontium titanate, or any other material, either ferroelectric or non-ferroelectric, having refractive index properties which vary in the presence of an applied electric field. Also, the material may comprise such doping materials having metallic doping, e.g., manganese, as may be deemed necessary to minimize insertion loss and maximize the variability of permittivity of the material.

The material is disposed in the slot in the form of a planar layer of substantially uniform thickness. The thickness is selected to establish at least a single wavelength (i.e., $2\pi$ radian) RF phase change under a selected electric field excitation level, as opposed to the RF phase in the unexcited (zero volts electric field) excitation level. A conductive electrode 130 is disposed in the center of the material. Imposed upon the electrode is the bias voltage from the source (not shown). The bias voltage is fed to the flange 124 by way of, e.g., a commercially available SSMA connector 132. From the connector 132, the bias voltage is fed to the electrode by a wire 134 disposed in the flange. The flange is held at electrical ground.

The voltage on the electrode sets up an electric field across the material 128. The electric field electrooptically varies the wave propagation constant (i.e., for a uniaxial ferroelectric, the extraordinary wave refractive index, $n_e$) Such variation changes the path length of the RF energy propagating therethrough, which shifts the phase of the RF energy exiting the material. The phase shift varies directly with the magnitude of the bias voltage on the electrode. After the RF energy propagates through the material 128, it enters a second waveguide 140 and propagates through an opening 142 therein to an output where it is radiated into free space.

The bias voltage establishes an electric field whose field lines originate from the electrode. Directional lines 144 illustrate the direction of the electric field. A suitably oriented uniaxial ferroelectric material will be polarized so that its optic axis is also horizontal. Changing the electric field will then vary the extraordinary wave refractive index, $n_e$, in the electrooptic ferroelectric material. Placing the electrode in the middle of the ferroelectric material isolates the electrode from the necessarily grounded waveguide, and also allows for a relatively low voltage requirement to achieve the desired electric field strength.

Located adjacent to the front and back sides of the ferroelectric material are impedance matching layers 146. The layers 146 comprise material, e.g., magnesium calcium titanate having a dielectric constant in the range of 15–140, similar to the impedance matching layers of FIG. 2. The resulting arrangement of ferroelectric material 128 and layers 146 has parallel front and back sides which are perpendicular to the propagation direction of the RF energy in the waveguides 120,140.

The magnesium calcium titanate is chosen to have a dielectric constant which equals the square root of the dielectric constant of the ferroelectric material. Such characteristic of the impedance matching layers provides for wide matching bandwidth. The layers are preferably fabricated into thin sheets or layers having a selected thickness. The layers are attached to each side of the ferroelectric material using adhesive or other known bonding techniques.

Assuming a dielectric constant of 625 for the ferroelectric material, the permittivity of each matching layer is 25 (i.e., the square root of 625). Low-loss microwave ceramics comprised of varying compositions of magnesium and calcium titanates are commercially available with dielectric constants in the range of 10 to 140, measured at the X frequency band. As these materials show no dispersion in the X band, it is expected that their dielectric properties will remain constant as the frequencies increase into the Ku frequency band. To achieve optimal radiation coupling, the impedance matching layers must be a quarter wavelength thick at the operating frequency. Such characteristic of the layers may reduce reflections off the ferroelectric material by nearly 100%. For a permittivity of 25, the matching layer thickness is 0.159 cm (about 59 mils) for operation at 10 GHz. Through use of impedance matching layers, the thickness of the ferroelectric material can be freely varied, limited only by structural considerations and insertion loss.

Both waveguides 120,140 are identical; thus, the following discussion, although with respect to the guide between the RF source 70 and phase shifter flange 124, is applicable to either guide. The guide is comprised of brass or other suitable metallic material. Within the guide is formed the opening 122 through which the RF energy propagates. The opening spans the entire length of the guide. Thus, the waveguide is of the closed, convention type.

The opening 122 begins at a surface which interfaces with the horn 70 and has predetermined dimensions thereat. The dimensions depend on the frequency of the RF energy to be propagated in the guide. For example, it is known that a waveguide designed to propagate frequencies in the Ku band has an opening with a width, $w_1$, of 0.311 inches and a height, h, of 0.622 inches. In an exemplary embodiment of the present invention for use in the Ku band, the opening at the horn surface surface has these exact dimensions.

However, it may be desirable to have a waveguide opening which gradually tapers downward in the width dimension along some (e.g., entire) length of the guide. In the exemplary embodiment illustrated, the length of the guide is approximately, e.g., five inches. The width dimension of the guide gradually tapers down along the length of the guide until it achieves a value, $w_2$, of 0.080 inches at a planar surface of the guide. This planar surface interfaces with the flange. Such gradual taper is desired to avoid internal reflections of the RF energy in the guide. Such reflections may be caused by a relatively sharp drop off in the width dimension. The height, h, of the opening may remain constant at 0.622 inches along the entire length of the guide.

Tapering the width dimension has no effect on the fundamental mode of the RF energy propagating in the guide. This is because the electric field polarization of the RF energy from the RF source is in a horizontal direction. Further, the bias electric field across the ferroelectric material is also in a horizontal direction. Because of these electric field orientations, the fundamental mode of the RF energy is not affected by the tapering of the width dimension. However, any tapering of the height dimension may affect the fundamental mode; therefore, the height is held relatively constant along the entire length of the guide. The taper of the width dimension to a smaller value at the point where the waveguide planar surface interfaces with the flange allows for smaller values of the voltage to produce the same induced electric field across the ferroelectric material.

The above discussion related to the guide disposed between the RF source and flange portion of the phase shifter is equally applicable to the guide 140 disposed following the flange. The guide is disposed such that the larger width dimension of the taper is at the antenna output and the smaller width dimension of the taper is at the flange.

The waveguides have been described as having a tapered width dimension. However, it is to be understood that, without limitation, dimensions other than the width may be tapered; further, in keeping with a broadest scope of the present invention, no dimension of the waveguide need be tapered, if desired. Further, in contrast to the antenna 10 of FIG. 2, the antenna illustrated in FIG. 3 may have the individual phase shifters 110–116 separated by an air gap 156.

Although the invention has been illustrated and described with respect to a best mode embodiment thereof, it should be understood by those skilled in the art that the foregoing and various other changes, omissions, and additions in the form and detail thereof may be made without departing from the spirit and scope of the invention.

We claim:

1. A phased array antenna, comprising:

a plurality of elements disposed in an array arrangement, wherein each element includes (A) an input waveguide which receives and routes RF energy;

(B) a phase shifting element disposed to receive the RF energy from said input waveguide, each of said phase shifting elements includes (i) a quantity of phase shifting material whose refractive index varies in the presence of an applied electric field, said phase shifting material being disposed in the path of the RF energy and having a first face through which the RF energy enters said material and a second face through which the RF energy exits said material as a phase shifted RF signal;

(ii) a pair of impedance matching layers including a first layer disposed adjacent to said first face and a second layer disposed adjacent said second face, such that, the RF energy propagates through said first layer before entering said phase shifting material and propagates through said second layer upon exiting said phase shifting material;

(iii) means for applying a variable electric field across said phase shifting material to vary the refractive index of said phase shifting material, said means for applying includes a first electrode which bisects said phase shifting material in a direction parallel to the propagation direction of the RF energy, and second and third electrodes located on opposite sides of said first electrode and spaced apart from said first electrode by said phase shifting material, such that a variable electrical potential applied to said first electrode creates an electric field across said phase shifting material in a direction normal to the propagation direction of the RF energy and parallel to the polarization direction of the RF energy; and (C) an output waveguide which receives said phase shifted RF energy from said phase shifting element and routes said phase shifted RF energy.

2. The antenna of claim 1, wherein said input waveguide further comprises:

a closed waveguide, having an opening of predetermined dimensions through which the RF energy enters and propagates along an entire length of said waveguide to said phase shifting material.

3. The antenna of claim 2, wherein said input waveguide has a width of said opening that is narrower towards said flange, and has a height that is constant in a direction towards said flange.

4. The antenna of claim 1, wherein said output waveguide further comprises:

a closed waveguide, having an opening of predetermined dimensions, for propagating the RF energy along an entire length of said waveguide in a direction away from said phase shifting material.

5. The antenna of claim 4, wherein the output of said output waveguide has a width dimension which widens in a direction away from said flange, and has a height dimension of said opening that is constant in a direction away from said flange.

6. The antenna of claim 3, wherein said width dimension is parallel to the polarization direction of the RF energy, and said height dimension is orthogonal to both the propagation direction and the polarization direction of the RF energy.

7. The antenna of claim 5, wherein said width dimension is parallel to the polarization direction of the RF energy, and said height dimension is orthogonal to both the propagation direction and the polarization direction of the RF energy.

8. An RF phase shifting element which receives RF energy and provides a phase shifted RF signal, said RF phase shifting element comprising:

a quantity of phase shifting material whose refractive index varies in the presence of an applied electric field, said phase shifting material being disposed in the path of the RF energy and having a first face through which the RF energy enters said material and a second face through which the RF energy exits said material as the phase shifted RF signal;

a pair of impedance matching layers including a first layer disposed adjacent to said first face and a second layer disposed adjacent said second face, such that, the RF energy propagates through said first layer before entering said phase shifting material and propagates through said second layer upon exiting said phase shifting material; and means for applying a variable electric field across said phase shifting material to vary the refractive index of said phase shifting material, said means for applying includes a first electrode which bisects said phase shifting material in a direction parallel to the propagation direction of the RF energy, and second and third electrodes located on opposite sides of said first electrode and spaced apart from said first electrode by said phase shifting material, such that a variable electrical potential applied to said first electrode creates an electric field across said phase shifting material in a direction normal to the propagation direction of the RF energy and parallel to the polarization direction of the RF energy.

9. The apparatus of claim 8, wherein said phase shifting material is ferroelectric material.

10. The apparatus of claim 9, wherein said ferroelectric material has extraordinary wave refractive index ($n_e$) properties which vary in the presence of an applied electric field.

11. The apparatus of claim 8, wherein said phase shifting material comprises barium strontium titanate.

12. The apparatus of claim 11, wherein said impedance matching layers comprise magnesium calcium titanate.

13. A phased array antenna, comprising:

a plurality of phase shifting elements disposed in an array arrangement, each of said phase shifting elements including a quantity of phase shifting material whose refractive index varies in the presence of an applied electric field, said phase shifting material being disposed in the path of the RF energy and having a first face through which the RF energy enters said material and a second face through which the RF energy exits said material as the phase shifted RF signal;

a pair of impedance matching layers including a first layer dispose adjacent to said first face and a second layer disposed adjacent said second face, such that, the RF energy propagates through said first layer before entering said phase shifting material and propagates through said second layer upon exiting said phase shifting material; and means for applying a variable electric field across said phase shifting material to vary the refractive index of said phase shifting material, said means for applying includes a first electrode which bisects said phase shifting material in a direction parallel to the propagation direction of the RF energy, and second and third electrodes located on opposite sides of said first electrode and spaced apart from said first electrode by said phase shifting material, such that a variable electrical potential applied to said first electrode creates an electric field across said phase shifting material in a direction normal to the propagation direction of the RF energy and parallel to the polarization direction of the RF energy.

14. The antenna of claim 13, wherein said phase shifting material is ferroelectric material.

15. The antenna of claim 14, wherein said ferroelectric material has extraordinary wave refractive index ($n_e$) properties which vary in the presence of an applied electric field.

16. The antenna of claim 13, wherein said phase shifting material comprises barium strontium titanate.

17. The antenna of claim 16, wherein said impedance matching layers comprise magnesium calcium titanate.

18. The antenna of claim 17, wherein each of said phase shifting elements further comprises:

input means, disposed prior to said phase shifting material, for receiving and conducting the RF energy to said phase shifting material; and output means, disposed following said phase shifting material, for receiving said phase shifted RF signal and for conducting said phase shifted RF signal away from said phase shifting material.

19. The antenna of claim 18, wherein said input means for receiving and conducting further comprises:

a waveguide including a pair of parallel plates (96) having a quantity of low dielectric material (94) disposed between said parallel plates, such that the RF energy is constrained by said plates to propagate through said low dielectric material to said phase shifting material.

20. The antenna of claim 18, wherein said output means for receiving and conducting further comprises:

a waveguide including a pair of parallel plates (96) having a quantity of low dielectric material (94) disposed between said parallel plates, such that the RF energy is constrained by said plates to propagate through said low dielectric material to said phase shifting material.

* * * * *